US005556898A

United States Patent [19]

Hutton et al.

[11] Patent Number: 5,556,898

[45] Date of Patent: Sep. 17, 1996

[54] RADIATION-SHIELDING POLYMERIC COMPOSITIONS

[75] Inventors: Leo T. Hutton, Oxford, N.J.; David J. Lavanga, Reading, Pa.

[73] Assignee: ELF Atochem North America, Inc., Philadelphia, Pa.

[21] Appl. No.: 371,186

[22] Filed: Jan. 11, 1995

[51] Int. Cl.[6] ..... G21F 1/10

[52] U.S. Cl. ..... 523/136; 523/137; 524/403; 428/242; 428/245; 428/260; 428/290

[58] Field of Search ..... 523/137; 428/242, 428/245, 254, 260, 262, 263, 264, 265, 290; 524/403

[56] References Cited

U.S. PATENT DOCUMENTS

| | | | |
|---|---|---|---|
| 3,950,271 | 4/1976 | Linares et al. | 252/478 |
| 5,130,342 | 7/1992 | McAllister | 521/61 |

*Primary Examiner*—Edward J. Cain

*Attorney, Agent, or Firm*—Stanley A. Marcus; William D. Mitchell; Royal E. Bright

[57] ABSTRACT

Radiation resistant, gadolinium oxide modified, thermoplastic polymers which may be used for containing nuclear waste.

5 Claims, No Drawings

RADIATION-SHIELDING POLYMERIC COMPOSITIONS

FIELD OF THE INVENTION

This invention relates to novel products for radiation shielding and for containment of nuclear materials such as nuclear waste. More particularly, it relates to gadolinium oxide-containing thermoplastic polymers which provide shielding against low level neutron and gamma radiation (typically up to about 60,000 electron volts), and to various forms in which these polymers may be used, such as a pressed sheet, a fabric-backed sheet or as part of a laminate.

Radiation-shielding constructions now employed, such as slab tanks for holding nuclear waste, are made up of laminates made by bonding or sealing a lead sheet between two thermoplastic sheets. In such laminates the edge of the thermoplastic has to be welded to seal the lead. This welding, however, risks exposure to lead fumes at the high temperatures required to seal the plastic. And, when the useful life of such a part is reached, the waste-containing lead must be disposed of in a safe manner.

It would thus be highly desirable to find a material that provides the required shielding in a single sheet, which avoids the use of lead, and which eliminates fabrication hazards and disposal problems associated with the use of lead.

Applicant is not aware of any prior disclosure of the inventive compositions.

STATEMENT OF THE INVENTION

A radiation resistant composition comprising a blend of a thermoplastic polymer and from about 1 to about 20 percent by weight of gadolinium oxide, based on the weight of the composition, is provided, the polymer optionally containing other additives such as calcium carbonate.

This invention also relates to various forms in which the composition may be employed, such as pressed sheets, fabric-backed pressed sheets, and laminates wherein the radiation resistant composition is sandwiched between two compatible thermoplastic sheets, and to methods of making the same.

DETAILED DESCRIPTION OF THE INVENTION

It has now been found that incorporation of a small amount of gadolinium oxide into a thermoplastic polymer results in a material which accomplishes the above objectives of providing protection against low level radiation while eliminating the problems associated with the use of lead.

The thermoplastic can be chosen to provide the most suitable and cost effective protection. Suitable polymers include, for example, polyethylene (PE), polypropylene (PP), fire resistant polypropylene (FRPP), chlorotrifluoroethylene (CTFE), ethylenechlorotrifluoroethylene (ECTFE), ethylenetrifluoroethylene (ETFE), and preferably, where the polymer is to be used in a corrosive environment requiring chemical resistance, vinylidene fluoride (VDF) polymers. "VDF polymer" refers not only to the homopolymers of VDF but also to the copolymers prepared from at least about 60% by weight of the VDF monomer. Comonomers may include other fluorinated monomers such as hexafluoropropylene ("HFP") and tetrafluoroethylene ("TFE"). Preferred are the homopolymers and the copolymers prepared from VDF and HFP. Minor amounts of other conventional additives, such as calcium carbonate and flame retardants, may also be added.

The preferred VDF polymer resins are those having a melt viscosity (according to ASTM D3835) in the range of from about 7 to about 30 Kp (kilopoise) at a shear rate of 100 $sec^{-1}$ and a temperature of 232° C. Examples of such polymers include KYNAR grades 2750, 2800, 2850, 2900, and 2950 (copolymers of VDF and HFP) and KYNAR grades 460, 710, 720, 740, and 760 (PVDF homopolymers) which are available from Elf Atochem North America, Inc. of Philadelphia, Pa.

The thermoplastic polymer is blended with from about 1 to about 20 weight percent gadolinium oxide, more typically about 5–15%, preferably by mixing both components in powder form. The gadolinium oxide is available in powder form, for example, from Research Chemicals of Phoenix, Ariz. For making a pressed sheet, the powder mix can be compression molded, typically with heated platens or a Carver press using a pressure of about 15,000–25,000 pounds (ram force). Sheet widths of from about one-eighths inch to about six inches are suitable for most low level radiation. Any additive(s) can be blended into the polymer using conventional polymer milling and mixing equipment so as to provide a good dispersion of the additive(s) in the base polymer. When the material to be contained is corrosive, an extra measure of protection can be provided by using a laminate wherein the thermoplastic/gadolinium oxide blend is placed between two sheets of compatible polymer and heat pressed. This multi-laminate sheet can be thermoformed, welded, cut and in general handled in a manner similar to those utilized for plastic sheets. Such a construction will prevent extraction of the gadolinium oxide by the corrosive environment. Fabric-backed sheet can be incorporated on one or both sides to permit bonding of the sheet, for example to the inside of the tank. The fabric will typically be chosen from glass cloth, carbon cloth, or a synthetic cloth such as a polyester.

The following examples are intended to be illustrative only:

EXAMPLES

Two multi-layer laminates were prepared using KYNAR 460 sheet, KYNAR 461 (a powder form of KYNAR 460 vinylidene fluoride homopolymer) and gadolinium oxide powder. The first such laminate (of one quarter inch thickness) was made by heat pressing, between 0.06 inch thick sheets of KYNAR 460, an eighth inch thick powder mix of 95% KYNAR 461 and 5% gadolinium oxide. The second laminate (of one half inch thickness) was made by heat pressing, between 0.09 inch thick sheets of KYNAR 460, a 0.3 inch thick powder mix of 85% KYNAR 461 and 15% gadolinium oxide. Both laminates were exposed to neutron and gamma radiation in the 60 KEV (60,000 electron volt) range and found to give acceptable shielding, in each case providing a shielding at least about 80% as effective as a comparable lead-based laminate but without the other problems associated with lead usage.

We claim:

1. A radiation and chemically resistant composition comprising a blend of a vinylidene fluoride polymer and from about one to about twenty percent by weight of said composition of gadolinium oxide.

2. A pressed sheet made from the composition of claim 1.

3. A pressed sheet as in claim 2 containing a fabric backing.

4. A laminate made by heat pressing the composition of claim 1 between two compatible thermoplastic polymer sheets.

5. A laminate as in claim 4 wherein the thermoplastic polymer of the outer sheets is a vinylidene fluoride polymer.

* * * * *